United States Patent [19]

Dahle et al.

[11] Patent Number: 5,007,487

[45] Date of Patent: Apr. 16, 1991

[54] METHOD AND APPARATUS FOR MAKING DRILL HOLES UNDER SPATIALLY RESTRICTED CONDITIONS

[75] Inventors: Olof Dahle, Reken; Manfred Fischbach, Hattingen, both of Fed. Rep. of Germany

[73] Assignees: Bergwerksverband GmbH; Hebben & Fischbach GmbH, both of Fed. Rep. of Germany

[21] Appl. No.: 479,366

[22] Filed: Feb. 12, 1990

[30] Foreign Application Priority Data

Feb. 25, 1989 [DE] Fed. Rep. of Germany ..... 3905999

[51] Int. Cl.[5] ..... E21B 17/04

[52] U.S. Cl. ..... 175/57; 175/122; 175/203; 175/220; 175/320; 285/330

[58] Field of Search ..... 175/320, 162, 203, 215, 175/207, 121, 113, 220; 285/118, 330, 138, 167, 261

[56] References Cited

U.S. PATENT DOCUMENTS

| | | | |
|---|---|---|---|
| 2,471,759 | 5/1949 | Lowrey | 285/330 X |
| 2,687,282 | 8/1954 | Sanders | 175/320 X |
| 2,879,033 | 3/1959 | Edwards et al. | 175/62 X |
| 3,446,297 | 5/1969 | Cullen et al. | 175/320 X |
| 4,378,057 | 3/1983 | O'Connell | 175/320 X |
| 4,402,372 | 9/1983 | Cherrington | 175/61 X |

*Primary Examiner*—Stephen J. Novosad

*Attorney, Agent, or Firm*—Thomas S. Baker, Jr.

[57] ABSTRACT

For making drill holes, in particular under cramped conditions, an apparatus is used which comprises a drill rod consisting of individual segments and guided in the cradle or slide. The individual segments comprise end pieces which are constructed as centering bushes and guide bushes and are to be pushed into each other in such a manner that the necessary torques and pressure forces can be effectively transmitted from the drilling motor. The drilling motor itself is displaceable between two clamping tongs which fix the drill rod or the individual segments and ensure that the latter form in each case a rigid unit to which the pressure and rotary forces can thus be effectively transmitted. The flushing hose extending in the individual segments is connected via a rotary duct to the guide segment of the drill rod so that said hose itself does not participate in the rotation and can therefore be led with the loosely engaging segments round a curve. Thus, even in for example low seams rock bolt drill holes of practically any desired length can be introduced.

10 Claims, 3 Drawing Sheets

Figure 1:
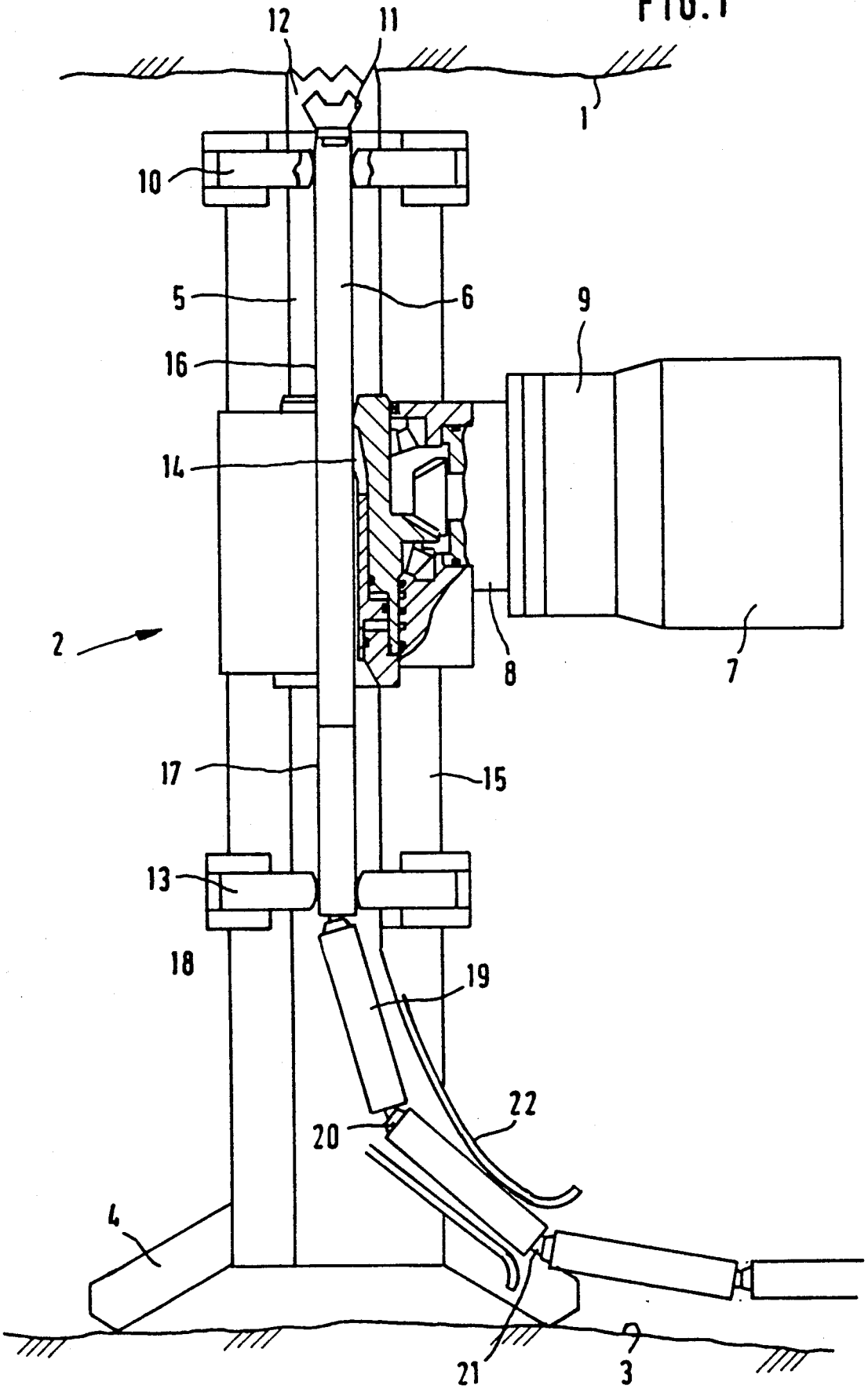

METHOD AND APPARATUS FOR MAKING DRILL HOLES UNDER SPATIALLY RESTRICTED CONDITIONS

The invention relates to an apparatus for making drill holes under spatially restricted conditions, in particular for anchor bolting in underground mining and tunnelling, consising of a drilling motor, the transmission members and the bore rod which is guided by a cradle and carries at the end facing the rock a drill bit and is equipped with an inner bore for supplying the flushing water.

Boreholes are driven into the rock in underground mining for a great variety of purposes this being done where possible with rotary drill machines or in harder rock with rotary percussive drill machines. Corresponding drill holes are required in driving or drifting for the blasting and for introducing rock bolts in order to secure in this manner the drifts or other underground excavations. Problems are repeatedly encountered because due to the cramped spatial conditions only relatively short construction drill machines or cradles or carriages carrying the drill rod can be employed. Particularly in rock bolting, but also in other drilling work, due to these facts the use of such rock bolts and similar work is restricted.

The invention is based on the problem of providing a drilling apparatus which permits great drilling lengths and can also be used under cramped conditions.

This problem is solved according to the invention in that the bore rod is made up of a plurality of segments which comprise at both ends guide members engaging in form-locking manner into the adjacent segment and are arranged displaceably on a flushing hose which takes up tensile forces and which is connected to the guide segment carrying the drill bit via a rotary duct and that the carriage provided with the drilling motor arranged displaceably thereon is constructed as the unit fixing the associated segments.

In such an apparatus it is possible to use drill rods of practically any desired length, the individual segments each being rigidly connected together in the region of the drill machine so that the drill machine can transmit the necessary driving and rotary forces Since always only a relatively short length of the drill rod is rendered rigid, such an apparatus can also be effectively used under very cramped conditions. The following segments arranged displaceably on the flushing hose do not participate in the rotation and thus, together with the likewise not rotating flushing hose, can be deflected without any problems to pull up the corresponding drill length after the drilling out, made rigid and then likewise pressed into the borehole.

After drilling out the drill hole the unit fixing the segment is loosened or released so that the segments arranged displaceably on the flushing hose can be withdrawn from the drill hole.

According to an expedient further development it is provided that the flushing hose has a greater length than the associated segments of the drill rod, ensuring that in the curve portion of the drill rod the individual segments are arranged pushed apart and thus not in mutual engagement, i.e. do not rotate as well. To avoid the segments sliding out an end piece is provided at the end of the flushing hose.

To make it possible to lay the drill rod consisting of the individual segments round curves without any problems the segments are expediently equipped at the end side additionally with guide members which facilitate such a placing of the drill rod. According to the invention, it is provided that the guide members are formed by a spherically and/or conically formed ring and correspondingly matching shells in the oppositely disposed ends of the segments. This thus ensures at the same time that on pushing together the individual segments the latter also engage so that the centering bushes or the corresponding projections and set-back portions engage in each other and thus produce the interlocking of the individual segments.

A relatively short unit, or one also of variable length, fixing the segments is obtained in particular in that the cradle or carriage is equipped at the end side of the drilling motor guide with clamping tongs. Via said clamping tongs in the pushing together and in the drilling operation a mutual fixing of the segments can be effected. This achieves that the rigid unit necessary for the transmission of the pressure and rotary forces is always obtained and inserted as such into the drill hole via the drilling motor. This work is advantageously facilitated in that the clamping tongs when relieved are switched to guiding the drill rod, this promoting the engagement of the drill rod segments and ensuring an exact guiding of the rigidified unit.

The introducing of the segments loosely disposed on the flushing hose into the region of the unit to be rigidified is faciliated in that the cradle or slide comprises a curve member adjoining the inner clamping tongs and acting as guide for the segments. Said curve member comprises outwardly a funnel-shaped edge in order to prevent catching of the segments and is widened in trumpet-like manner at the end facing the inner clamping tongs to direct the rigid segments reliably into the region of the clamping tongs.

An exact bracing of the drilling apparatus is made possible in that the cradle comprises an extensible centering mandrel. This centering mandrel, for example hydraulically extensible, thus permits a bracing in particular between roof and floor so that an exact introduction of the respective rigidified unit into the rock is ensured.

A very compact drive unit, because it acts on the drill rod from the side, is achieved according to the invention in that the drilling motor comprises a planetary gearing with bevel gear takeoff or alternatively for example a spur gear mechanism with which driving clamping tongs are associated. Said entraining clamping tongs ensure that the torque and pressure forces are transmitted in form-locking or friction-locking manner to the drill rod.

In particular where harder rock is left or encountered, the drilling work can be facilitated according to the invention in that high-pressure water is also employed. For this purpose the flushing hose is constructed as high-pressure hose. As a result the rotary drilling can be conducted with high-pressure water assistance and at the same time by appropriate construction of the flushing hose the necessary tensile forces can also adequately be taken up by said flushing hose when for example a drill rod having a corresponding drill length must be withdrawn from the drill hole.

The invention is distinguished in particular in that a very compactly formed drilling apparatus is provided which for example also permits rock bolting in the longwall face without any problems because the length of the drill holes is not defined by the associated cradle or the drill rod but on the contrary can be set and selected in accordance with the particular conditions. The drill rod consists of individual segments which nevertheless securely engage in each other and thus form rigid units to which the necessary torque and the necessary pressure force is then to be applied.

Figure 2:
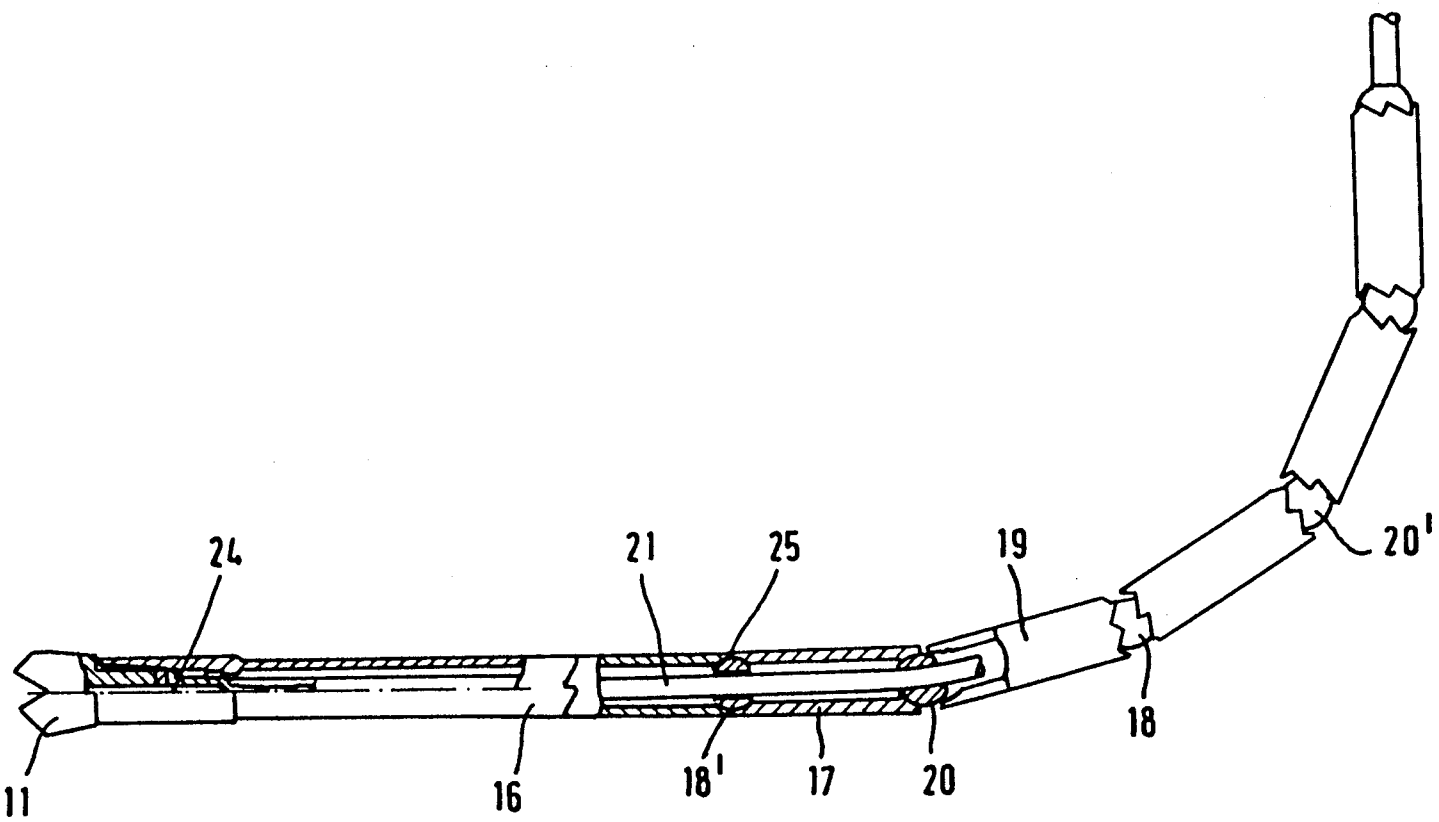
Figure 3:
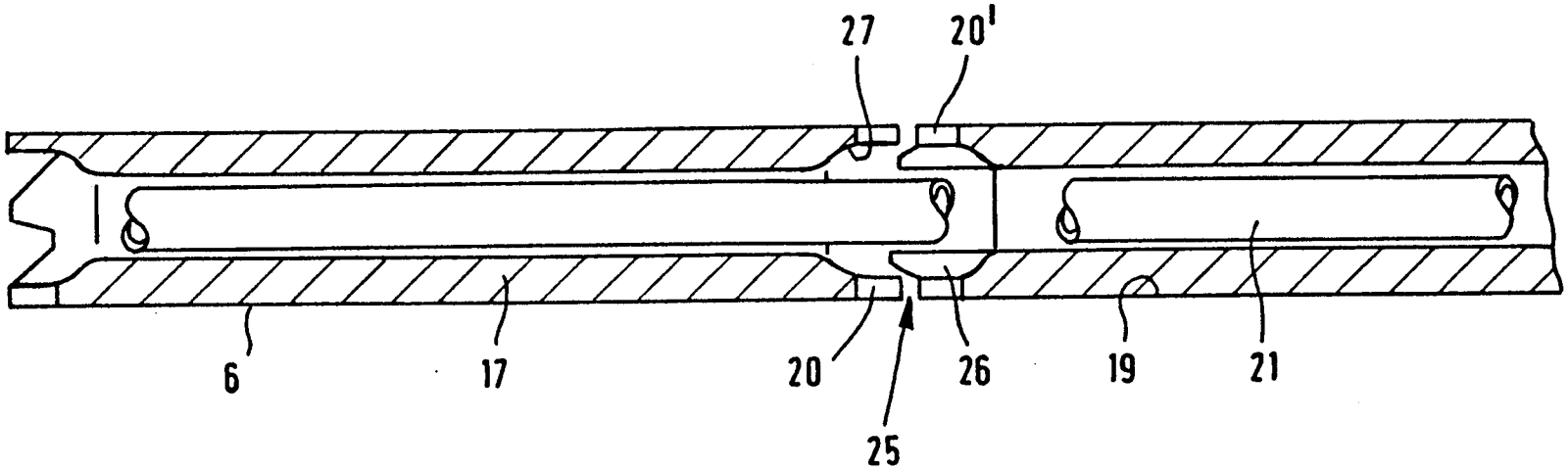

The invention will be additionally described with the aid of the drawings which are explained below and in which:

FIG. 1 shows a drilling apparatus partially in section braced between roof and floor, FIG. 2 shows partially in section a drill rod consisting of individual segments and placed in a curve and FIG. 3 shows in section the connection region between two segments of the drill rod.

FIG. 1 shows a drilling apparatus 2 arranged in the longwall face and braced between roof 1 and floor 3. The drilling apparatus 2 comprises a support 4 with which it is placed on the floor 3 which practically merges into the cradle 5 or member representing the support of the drilling apparatus.

Arranged guided and clamped in the cradle 5 is a drill rod 6 which via the drilling motor 7 is both advanced in the direction of the rock, i.e. the roof 1, and at the same time rotated. For this purpose transmission members 8 and in particular the planetary gearing 9 as well as a corresponding clamping means are associated with the drilling motor 7.

The clamping means is formed by front clamping tongs 10 associated with the drill crown 11 and rear clamping tongs 13 as well as the driver or entraining clamping tongs 14 arranged therebetween and transmitting the pressure forces and the torque. It is possible in this manner to move the drill rod in the direction of the roof 1, the drill rod 6 consisting of individual segments first being moved together and then influenced as rigid unit via the driver clamping tongs 14 and the drilling motor 7. The drilling motor 7 is then moved together with the drill rod 6 via the driver clamping tongs 14 along the drilling motor guide 15, the drill rod 6 simultaneously being driven into the rock. The driving is facilitated and an exact arrangement achieved in that in the region of the drill crown or bit 11 a centering mandrel 12 is arranged which can be hydraulically extended and thus also permits simultaneously a bracing of the entire drilling apparatus 2 between the roof 1 and floor 3.

As already indicated above the drill rod 6 consists of a plurality of segments, the guide segment 16 comprising shells 27 on only one side but the other segments 17, 19 having them on both sides. Guided centrally through the segments 16, 17, 19 is a flushing hose 21 on which the individual segments can be displaced as indicated in FIG. 1. The toothing 20 is formed so that in the pushed-together state of the segments 16, 17, 19 a claw-like interengagement is achieved so that the already mentioned rigid unit between the clamping tongs 10, 13 results. The pressure and rotary forces are then applied to said rigid unit. The flushing hose 21 comprises at its end an endpiece to prevent the segments 16, 17, 19 sliding out.

Outside the clamping tongs 10, 13 the segments 19 are loosely disposed on the flushing hose 21 so that assisted by the curve member 22 they can be led round practically any curves. This makes it possible as shown in FIG. 1 to guide the bore rods fixed in the form of its interlocked segments 16, 17, 19 along the floor 3 and then bring it into the vertical position to influence it via the drilling motor 7 in its interlocked state.

On starting drilling the drilling motor 7 is disposed with opened driver clamping tongs 14 at the end of the cradle or carriage 5. The front clamping tongs 10 are slightly opened, the rear clamping tongs 13 closed, to prevent the drill rod 6 or the segments 16, 17 forming a rigid unit from sliding back. If the driver clamping tongs 14 are now closed the rear clamping tongs 13 open and the drilling motor 7 can be switched on. The initial drilling is effected with moderate application pressure. Only after complete engagement of the drill head or drill bit 11 is the application force increased.

After reaching the front end position the drilling motor 7 is switched off and the front clamping tongs 10 as well as the rear clamping tongs 13 closed so that the drill rod 6 is fixed. The driver clamping tongs 14 are now opened and the drilling apparatus 2 returns to the starting position. The driver clamping tongs 14 are closed and the rear clamping tongs opened The individual segments 17, 19 are brought together by the drilling apparatus with low speed of rotation until they have interlocked and give a formlocking connection. The front tongs 10 are now opened and the drilling operation can be continued with the necessary rotary speed and application pressure force. The entire operation can take place automatically with a slave or follow-up control.

FIG. 2 shows the drill rod 6 in separate illustration, clearly showing that guide members 25 are provided additionally to the centering bushes 18, 20 to assist the arcuate guiding of the individual segments 17, 19. Said guide members 25 consist firstly of a spherical or conical ring 26 and shell 27 arranged at the opposite end of the segments 17, 19. The two parts are adapted to each other so that at the same time they also assist the interengagement of the toothing 20.

Within the individual segments 16, 17, 19 of the drill rod 6 the flushing hose 21 extends and in the region of the guide segment 16 is connected via a rotary duct 24 to said segment. This effectively prevents entraining of the flushing hose 21 and ensures that only the particular segments arranged between the clamping tongs 10, 13 participate in the rotation. The thickness or strength of the flushing hose 21 may be so dimensioned that a rotary drilling with high-pressure water assistance is possible. On withdrawing the individual segments 16, 17, 19 of the drill rod 6 after completing the drill hole the flushing hose can possibly push the segments out of the drill hole.

FIG. 3 shows the connection beteen two segments 17, 19 to a greater scale, showing in particular the formation of the guide member 25 and toothing 20. The flushing hose 21 extends within the bore of the drill rod 6.

We claim:

1. A drilling apparatus for drilling straight holes under spatially restricted conditions which comprises:

a longitudinally extending cradle; a fixed front clamping tong mounted on said cradle adapted to clamp a drill rod; a fixed rear clamping tong mounted on said cradle adapted to clamp a drill rod; a movable drive clamping tong mounted on said cradle intermediate said front and rear clamping tongs adapted to clamp and drive a drill rod; drive means for rotating and advancing said drive clamping tong to thereby rotate and advance a drill rod; a drill rod having a plurality of hollow segments; interlock means at each end of said segments for interlocking adjacent segments to form a straight rigid drill rod when said adjacent segments are brought into engagement with each other; a flexible member which passes through each of said segments such that said segments are movable longitudinally along said flexible member between a first position in which two adjacent segments are interlocked to form a straight rigid drill rod portion and a second position in which adjacent segments are spaced from each other to enable said flexible member to bend and said spaced segments to move along a curved defined by said flexible member.

2. The drilling apparatus of claim 1 further comprising a centering bush having a bore adapted to receive said flexible member mounted within each drill rod segment.

3. The drilling apparatus of claim 1 further comprising guide means located at opposite ends of said drill rod segments having a central bore for receiving said resilient member and adapted to assist the engagement of said interlock means of adjacent segments when said adjacent segments are moved from said second position to said first position.

4. The drilling apparatus of claim 1 in which each of said guide means has an inner ring with said central bore and an outer shell adapted to overlie said inner ring when adjacent segments are in said first position.

5. The drilling apparatus of claim 1 in which; said resilient member is a fluid conduit.

6. The drilling apparatus of claim 1 further comprising:

a drilling motor guide which mounts said drive means for said drive clamping tong.

7. The drilling apparatus of claim 6 in which:

said drive means operates to simultaneously rotate said drill rod and move said drive clamping tong between said rear clamping tong and said front clamping tong.

8. The drilling apparatus of claim 1 further comprising:

a guide mounted on said cradle upstream of said rear clamping tong; and wherein said drill rod segments are in said second position when they pass through said guide and said drive means moves said drill rod segments into said first position after they pass through said rear clamping tong towards said front clamping tong.

9. The drilling apparatus of claim 1 further comprising; an extensible centering mandrel mounted on said cradle and adapted to lock said cradle in position between a floor and a ceiling.

10. A method of drilling bore holes utilizing a drill hole apparatus having a longitudinally extending cradle, a fixed front clamping tong mounted on said cradle adapted to clamp a drill rod, a fixed rear clamping tong mounted on said cradle adapted to clamp a drill rod, a movable drive clamping tong mounted on said cradle intermediate said front and rear clamping tongs adapted to clamp and drive a drill rod, drive means for rotating and advancing said drive clamping tong to thereby rotate and advance a drill rod, wherein said drill rod has a plurality of hollow segments, interlock means at each end of said segment for interlocking adjacent segments to form a straight rigid drill rod when said adjacent segments are brought into engagement with each other, and a flexible member which passes through each of said segments such that said segments are movable longitudinally along said flexible member between a first position in which two adjacent segments are interlocked to form a straight rigid drill rod portion and a second position in which adjacent segments are spaced from each other to enable said spaced segments to move along a curve defined by said flexible member comprising the steps of:

opening said front clamping tong;

closing the rear clamping tong;

moving the drive clamping tong to a position adjacent said rear clamping tool;

closing said drive clamping tong;

opening said rear clamping tong;

operating said drive means to interlock adjacent drill rod segments, rotate said drill rod and move said drive clamping tong and said drill rod upwardly toward said front clamping tong.

* * * * *